United States Patent [19]

Kreiskorte

[11] 4,235,088

[45] Nov. 25, 1980

[54] SERVOHYDRAULIC PRESS WITH A CLOSED LOOP CONTROL CIRCUIT AND METHOD OF OPERATING A FLUID PRESSURE OPERATED PRESS

[75] Inventor: Heinz Kreiskorte, Dortmund, Fed. Rep. of Germany

[73] Assignee: Thyssen Industrie AG, Fed. Rep. of Germany

[21] Appl. No.: 952,456

[22] Filed: Oct. 18, 1978

[30] Foreign Application Priority Data

Oct. 22, 1977 [DE] Fed. Rep. of Germany ..... 2747548

[51] Int. Cl.[3] ..... B21J 9/12; B30B 1/32

[52] U.S. Cl. ..... 72/453.18; 72/451; 72/453.07; 100/269 R

[58] Field of Search ..... 72/453.18, 453.01, 453.02, 72/453.05, 453.07, 453.06, 453.13, 350, 351, 312, 445; 100/269 R

[56] References Cited

U.S. PATENT DOCUMENTS

| | | | |
|---|---|---|---|
| 2,243,986 | 6/1941 | Stacy | 72/351 |
| 2,350,884 | 6/1944 | Ernst | 72/351 |
| 3,180,129 | 4/1965 | Riemenschneider | 72/453.18 |
| 3,735,630 | 5/1973 | Sondergaard | 72/453.06 |
| 3,940,930 | 3/1976 | Rosander | 100/269 R |
| 4,125,010 | 11/1978 | Adam | 72/453.06 |

FOREIGN PATENT DOCUMENTS

| | | | |
|---|---|---|---|
| 349592 | 10/1972 | U.S.S.R. | 72/453.18 |
| 371090 | 5/1973 | U.S.S.R. | 100/269 R |
| 373178 | 6/1973 | U.S.S.R. | 100/269 R |

*Primary Examiner*—Francis S. Husar

*Assistant Examiner*—Gene P. Crosby

*Attorney, Agent, or Firm*—McGlew and Tuttle

[57] ABSTRACT

A fluid pressure operated press has a drive piston which is movable in a cylinder and has a drive surface side and an opposite return surface side which is connected with a ram which operates on a workpiece. An accumulator is connected to the respective cylinder spaces disposed on the respective drive and return surface sides through a control so as to effect the movement of the piston in a drive direction by admission of a fluid pressure source and pressure from an accumulator in a selected amount to the cylinder space on the drive surface side. The return of the drive piston is effected by applying a fluid pressure to the return surface side. A difference in the areas of the return surface side of the drive piston and the combination of the drive surface side with a central area surface associated with the drive surface side, defines an effective piston area. The accumulation is selectively connectable to the cylinder to effect a fluid pressure over the effective piston area which is in order to permit the fluid pressure on the central piston area side to direct flow to the accumulator so that the piston will be displaced against the accumulator pressure. A part of the force acts on the return side overcoming friction to lift the drive piston from the workpiece. Fluid pressure is removed from the accumulator as needed during the return movement in an amount equal to the product of the stroke times the return side area, and fluid pressure is delivered to the accumulator in an amount of the stroke times the drive side piston area so that the product of the fluid spent during the return movement equals the stroke times the difference between the effective surface areas of the drive side and the return side.

13 Claims, 4 Drawing Figures

SERVOHYDRAULIC PRESS WITH A CLOSED LOOP CONTROL CIRCUIT AND METHOD OF OPERATING A FLUID PRESSURE OPERATED PRESS

FIELD AND BACKGROUND OF THE INVENTION

This invention relates to fluid pressure operated presses for operating on workpieces in general and, in particular, to a new and useful fluid pressure operated press having a servo control system for effectively distributing pressure on respective drive and return sides of a drive piston and for accumulating pressure so that a minimum amount of fluid pressure is spent during the operation.

DESCRIPTION OF THE PRIOR ART

In servohydraulically controlled presses, operated with the aid of a closed-loop control circuit, the drive piston is held in a drive cylinder between two variable pressure fluid columns. Generally, the drive cylinder is supplied with the pressure fluid from a hydraulic station comprising an accumulator system. The flow of the pressure fluid into the cylinder spaces is controlled by means of so-called servo valves, i.e., valves in which the rate of flow or pressure of the fluid varies in proportion to an electric control signal.

The working pressures of presses comprising such a servo-hydraulic system result from the difference of the fluid pressures acting on the two piston surfaces, i.e., the difference between the respective products of each piston surface area times the pressure present in the associated cylinder space. Due to the continuously variable pressures on both sides of the piston, such presses make possible both a smooth transition from a pressing to a pulling force and a reversal without shocks and jolts.

The servohydraulic presses of the prior art, in which the stroke or the force can be controlled, offer considerable advantages under the various working conditions, since they are capable of following exactly any electric control signals. However, they have the disadvantage that, due to the double-acting drive piston, they use more pressure fluid than presses of a different design. This is substantially caused by the fact that to obtain a definite control action, the ratio of the two piston surface areas cannot be chosen arbitrarily. For reasons of the control technique, the piston surface area for the return generally must be larger than that required by the work to be performed by the press. However, the necessity of providing a larger piston surface for the return results in a greater consumption of oil.

SUMMARY OF THE INVENTION

The present invention is directed to the elimination of a greater oil consumption for the return of the drive piston and to a reduction of the energy consumption of servohydraulic presses.

Beginning with the above-described design of a servohydraulic press operating with a closed-loop control circuit and having a drive piston held in the drive cylinder between two variable pressure fluid columns, the invention provides that the surface area for the return of the drive piston is considerably larger than necessary for the return force, and that the drive piston is connected to a power accumulator system in which the excess energy produced during the return movement of the drive piston can be accumulated.

Since, as a rule, considerably less power is needed for the return of the drive piston than is available for the return in view of the extent of the piston surface, the inventive provision of a power accumulator system or a plurality of such systems results in the advantage that while utilizing the return force which is not needed, the accumulator system can be loaded and energy recovered, and/or the working pressure of the drive piston can be increased without an additional supply of energy.

An embodiment of the invention which is particularly advantageous for this purpose, and for a versatile operation of the press, provides that, aside from the mentioned first cylinder piston system, the press is equipped with at least one second cylinder piston system functioning as a power accumulating system and comprising a piston which is actuable by the drive piston and a cylinder which is connected to a pressure accumulator. Aside from the energy storage, this design offers the particularly advantageous possibility of increasing the working pressure of the drive piston and, in addition, of performing additional operations with the press.

Experience has shown that the invention offers considerable advantages, particularly, if the piston surface areas of the drive piston are made at least approximately equal to each other and the drive piston is directly connected to the piston of the additional cylinder-piston system, with the cylinder space of the second cylinder-piston system communicating with the pressure accumulator of the drive cylinder through a fluid line, with the possible interposition of a check valve and/or control valve.

During the return of the drive piston, on the one hand, pressure fluid is removed from the pressure accumulator in an amount corresponding to the product of the stroke and the surface area of the drive piston which is loaded during the return and, on the other hand, pressure fluid is supplied to the accumulator in an amount corresponding to the product of the stroke of the drive piston and the drive portion surface area of the second cylinder piston system. Thus, the amount of fluid needed during the return of the drive piston equals the product of the drive piston stroke times the difference between the two mentioned piston surface areas.

The question which arises in this connection, i.e., why, under these circumstances, the drive piston surface area loaded during the return movement is not directly designed smaller, may be answered to the effect that the control action of a servohydraulic system having equal or approximately equal piston surface areas is substantially better, for example, than a system having a piston surface ratio of 10:1, as is quite usual in conventional hydraulic presses.

It is possible to operate the inventive press both with and without a check valve in the line leading from the second cylinder space to the pressure accumulator. If it is operated without such a check valve, the advantage obtained is that during the working movement of the press, an additional force is available, resulting from the product of the accumulator pressure and the piston surface area of the second cylinder piston system. The maximum working pressure may thereby be increased by up to about 80%.

In addition, the invention makes it possible, in the course of a pressing operation, to produce the working pressure initially only by loading the drive piston in the first cylinder piston system, while the second cylinder piston system takes in pressureless fluid from a tank, through a check valve. Only after the power in the first cylinder piston system is exhausted, is the second cylinder piston system engaged. The energy consumption is smaller, the later the second cylinder piston system is put into operation.

The inventive arrangement also makes it possible to initially apply a working pressure on the drive piston only by means of the second cylinder piston system and then, as this working pressure no longer suffices for continuing the working operation, to apply, in addition, the first cylinder piston system with the closed-loop control circuit. It is further possible to apply both cylinder piston systems through the servovalve and the closed-loop control circuit, so that the total working pressure from both systems is subjected to the control.

To save the pressure fluid which would otherwise be needed during the idle part of the working stroke of the press for filling the cylinder space on the working side of the drive piston in the first cylinder piston system, a development of the invention provides that the two piston surface areas are equal to each other and the cylinder spaces of this system are connected to each other, in addition or, selectively, through a control valve, so that with the control valve open, the drive piston with the press ram which is usually secured thereto may move downwardly under its own weight. At the same time, the lines connecting the cylinder spaces of the drive cylinder to the pressure accumulator are shut off by means of the servovalve or, if provided, an additional valve, so that no pressure fluid is removed from the pressure accumulator.

Finally, the invention provides the use of a mechanical spring as the sole or additional power accumulator, which is tensioned by the drive piston during the return movement thereof. The energy accumulated in this spring is available during the working movement of the drive piston and supports the hydraulically produced working pressure.

It is irrelevant to the invention whether the distance or the force is controlled in the inventive hydraulic press and whether way-type or servo-pressure valves, known per se, are used for controlling the flow of the fluid.

Accordingly, it is an object of the invention to provide a method of operating a fluid pressure operated press which has a drive piston movable in a cylinder with a drive surface side and an opposite return surface side and with a ram connected to the return surface side which is operable on a workpiece and using an accumulator of fluid pressure selectively connectable to the drive and return surface sides in a manner to use an optimum amount of fluid pressure which comprises directing the fluid pressure against the drive side to move the drive piston to engage the workpiece, and to return the drive piston, applying a fluid pressure to the return surface side over an effective piston area which is smaller than the area of the drive surface side and to simultaneously connect the drive surface side to the accumulator so as to enable the fluid pressure to be displaced against the accumulator pressure and so that a part of the force acts on the return side to overcome friction and to lift the drive piston from the workpiece and also as a pull back force as needed and, wherein, fluid pressure is removed from the accumulator as needed during the return movement in an amount which is equal to the product of the stroke times the return side area and fluid pressure is delivered to the accumulator in an amount equal to the stroke times the drive side area so that the product of the fluid spent during the return movement is equal to the stroke times the difference between the surface areas of the drive and return sides of the piston.

A further object of the invention is to provide a servohydraulic press comprising a press ram actuable by a cylinder piston system through a double-acting drive piston in which the working surface and the return surface of the drive piston are loadable with pressure fluid simultaneously through a valve having no firmly set switching position, such as a servo-valve, in which the rate of flow or pressure of the fluid varies in proportion to an electric control signal; which is a component part of a closed-loop control circuit and, wherein, the return surface area of the drive piston is considerably larger than that required for the needed return force, so that the fluid pressure is directed into a pressure accumulator system which is connected to the drive piston in which the energy in excess produced during the return movement of the drive piston is accumulated.

Another object of the invention is to provide a hydraulic press for forming a workpiece which comprises a working cylinder, a drive piston movable in the cylinder having a first drive surface side and an opposite second return side, the cylinder having a first space in which the first side is movable and a second space in which the second side is movable and with a ram connected to the drive piston second side and being movable by the drive piston to contact and to form a workpiece and which includes fluid pressure supply means with a servo-valve having respective alternately operable connections to the respective first and second cylinder spaces for selectively pressurizing and relieving said spaces and including a pressure accumulator connected to the servo-valve for selectively communicating the accumulator to the respective first and second cylinder spaces.

A further object of the present invention is to provide a servohydraulic press which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
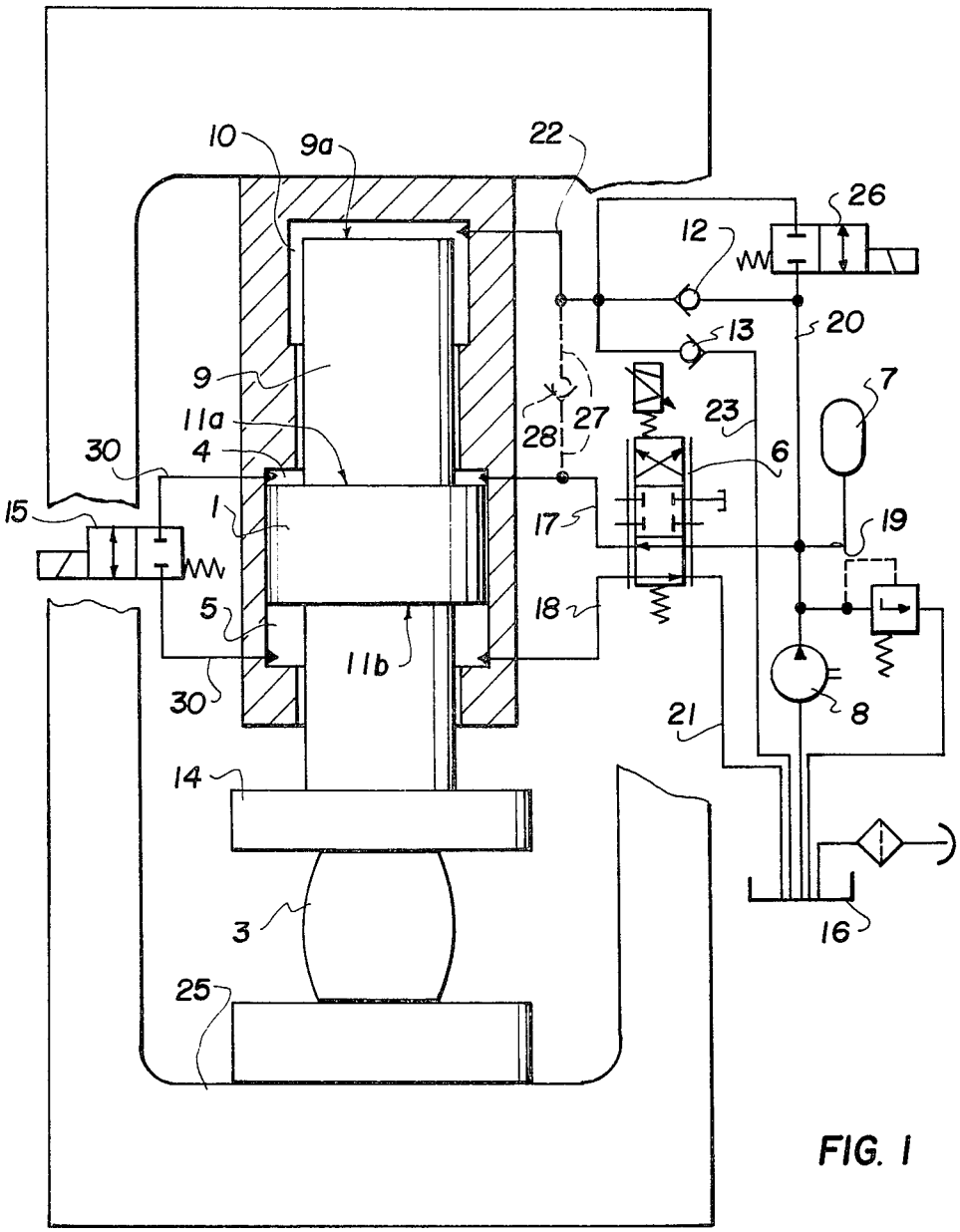
FIG. 1 is a diagrammatical view, partly in section, of a servohydraulic press having a drive piston area and a piston surface area which are substantially equal to each other and comprising an additional cylinder piston system to recover energy, constructed in accordance with the invention.

Referring to the drawings in particular, the invention embodied therein in FIG. 1, comprises, a fluid pressure operated press or servohydraulic press, which includes a drive piston 1, movable in a working cylinder 2, and which has a ram 14 connected to a return surface side 11*b* of the piston, which is operable on a workpiece 3 to form the workpiece over a support base of a press frame 25.

In the servohydraulic press of FIG. 1, a workpiece 3 is loaded by means of a drive piston 1. A working cylinder 2 is mounted in a press frame 25 in a manner known per se, and is thus not shown, so that the system is pressure-locked. The desired working pressure is effective in respective cylinder spaces 4 and 5 and acts on respective first and second opposite drive and return piston surfaces 11*a* and 11*b*. With the aid of a servo-valve 6, the hydraulic pressure in cylinder space 4 is increased by a supply from pressure accumulator 7 through lines 19 and 17 and is decreased in cylinder space 5 through lines 18 and 21, to produce a working pressure acting on a workpiece 3, for example. The pressure difference multiplied by the piston surface gives the working pressure acting on the workpiece, if the friction is disregarded.

The control circuit needed for actuating servo-valve 6 is not shown in FIG. 1, since it is known per se. Usually, a closed-loop control circuit is employed for this purpose, with the possibility of controlling the stroke and/or the working pressure. Lifting force and working pressure follow an electrically preset desired value. In a manner known per se, the closed-loop control circuit comprises a distance and/or pressure pickup and a measuring amplifier by which the stroke and/or pressure signal is converted into a proportional voltage, and a control amplifier in which the preset and actual values are compared with each other. The servo-valve 6 releases the oil flow to or from cylinder spaces 4 and 5, in proportion to the control voltage (distance or pressure pickups, measuring amplifier, and control amplifier are known per se and thus are not shown, for clarity).

Cylinder spaces 4 and 5, in which drive piston 1 is exposed to pressure, are supplied with pressure fluid from the pressure accumulator 7 which is pressurized by means of a pump 8. Due to the provided accumulator, the press is operated at a substantially constant supply pressure. It is sufficient if pump 8 is designed for an average delivery since the peak supply of the fluid at high piston velocities is covered from the pressure accumulator 7.

To save pressure fluid and, thereby, energy, a second cylinder piston system is provided within working cylinder 2 in such a manner that working cylinder 2 includes another cylinder space 10 into which drive piston 1 projects by a cylindrical extension forming a central piston 9 with a piston surface 9*a* which can be loaded from the pressure accumulator 7. During the return movement of drive piston 1, piston surface 9*a* displaces pressure fluid from cylinder space 10 through line 22, a check valve 12, return line 20, and line 19 into pressure accumulator 7. To enable the pressure fluid to be displaced against the accumulator pressure from cylinder space 10 into pressure accumulator 7, piston surface area 9*a* of drive piston 1 is made smaller than piston surface area 11*b*. A part of the force acting on surface 11*b* serves to overcome the friction, to lift the drive piston, displace the pressure fluid from cylinder space 4 and, if needed, as a pull-back force during the working operation.

Thus, during the return movement of drive piston 1, fluid is removed from pressure accumulator 7 in an amount corresponding to the product of the stroke of piston 1 times piston surface area 11*b*, and fluid is delivered to accumulator 7 in an amount corresponding to the product of the stroke of piston 1 times piston surface area 9*a*. The volume of pressure fluid spent during the return movement therefore corresponds to the product of the stroke of drive piston 1 and the difference between the piston surface areas 11*b* and 9*a*, and is relatively small.

In presses where a check valve 12 is not provided or remains open, or where a control valve 26 connected in parallel to check valve 12 is switched to free passage, an additional force is available during the working movement of drive piston 1, resulting from the multiplication of piston surface area 9*a* by the pressure in accumulator 7, so that the maximum working pressure may be increased, for example, by up to 80%.

It is further provided that during the working stroke of the drive piston 1, first, pressureless fluid is taken in from a reservoir or tank 16 into cylinder space 10 through a check valve 13 and line 23, and only then, as press ram 14, which is secured to drive piston 1 and provided with the moving tool part, known per se and not shown, abuts against workpiece 3, pressure fluid is supplied from pressure accumulator 7 to cylinder space 10, preferably, while making use of the correspondingly controlled valve 26, known per se.

On the other hand, it is also possible to first load drive piston 1 through cylinder spaces 4 and 5 only, and only then to add the loading of piston surface 9*a*, after the power of the first cylinder piston system 1, 4 has been exhausted. The energy consumption is smaller, the later the action of the second cylinder-piston system 9, 10 is added. In order to enable the loading of both cylinder piston systems with pressure fluid at the same time and in a controlled manner, it is alternatively provided to interconnect lines 17 and 22 by a line 27 and a check valve 28. This possibility is shown in FIG. 1 in a dotted line. In this alternative, check valve 13 and connecting line 23 to tank 16 must be omitted.

To save the pressure fluid which, during the idle part of the working stroke of the press is needed for filling the cylinder space 4, a control valve 15 is provided in addition to the hitherto described measures by which, and through lines 30, cylinder space 4 and 5 can be connected to each other, so that, with valve 15 open the pressure on the drive and return surfaces is equalized and drive piston 1 with press ram 14 can move downwardly under their own weight, without having to remove pressure fluid from pressure accumulator 7. During this motion, the servo-valve 6 is brought into a mid-position, so that the flow from pressure accumulator 7 to cylinder spaces 4 and 5 is shut off. After drive piston 1 reaches a predetermined position, or press ram 14 with the moving tool part abuts against workpiece 3, control valve 15 is closed and the press may again work under the closed-loop control. Another possibility is to apply a working pressure initially through the second cylinder-piston system 9, 10 and only then, as this pressure is no longer sufficient, to add the action of the first cylinder piston system comprising the cylinder spaces 4 and 5 and controlled by the closed-loop circuit.

Figure 2:
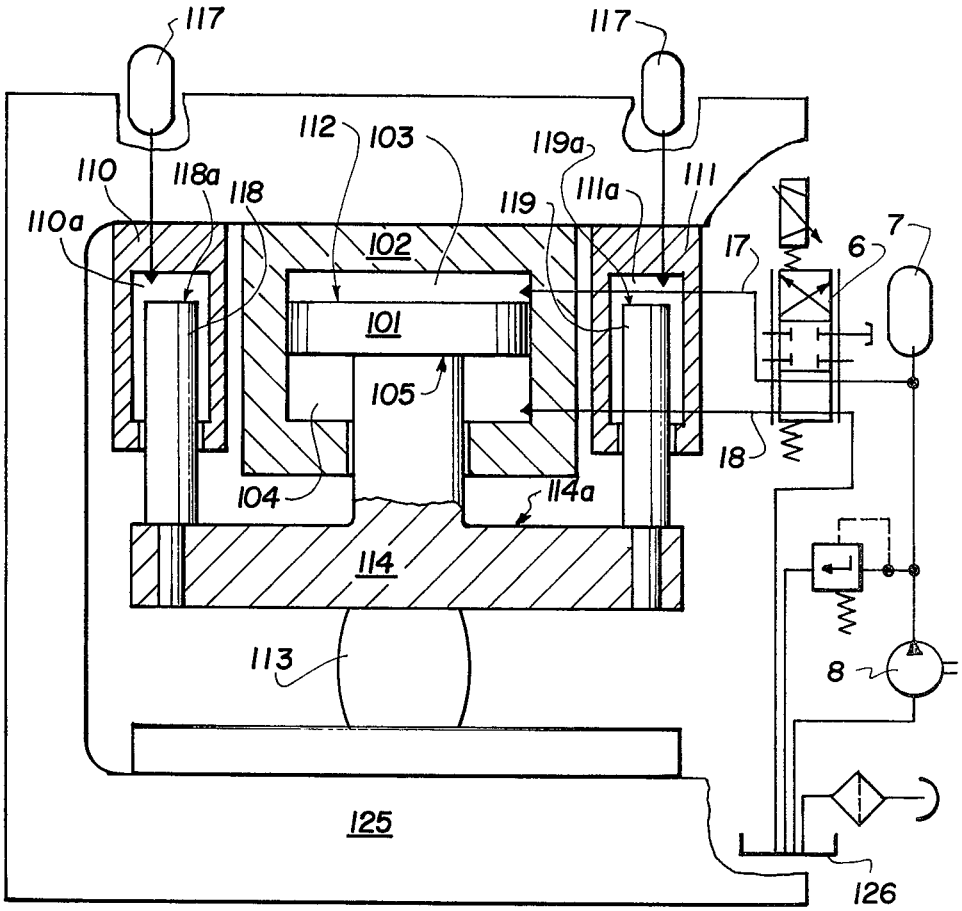
FIG. 2 is a view, similar to FIG. 1, of another embodiment of the invention, wherein, the press has unequal piston surface areas and comprises two additional cylinder piston systems for recovering energy

In the embodiment of FIG. 2, the first cylinder piston system comprises a working piston 101 with piston surfaces 105 and 112, and a cylinder 102 with cylinder spaces 103 and 104. The second cylinder piston system comprises two cylinders 110 and 111 provided at both sides of cylinder 102 and having cylinder spaces 110*a* and 111*a*, and associated pistons 118 and 119. The respective piston surfaces are shown at 118*a* and 119*a*. In this design of the inventive press, the pressure on drive piston 101 becomes effective through cylinder spaces 103 and 104 which are connected to pressure accumulator 7 or tank 126 through lines 17 and 18 and servo valve 6.

The surface areas 105 and 112 of drive piston 101 are not equal to each other. In order to obtain a satisfactory control of the press, piston surface area 105 is made larger than necessary for obtaining the needed pull-back force. The pull-back force in excess is utilized to displace pressure fluid from the second cylinder piston system 110, 118 and 111, 119 into pressure accumulators 117 and 117*a*. At the lefthand side of FIG. 2, it is shown how the accumulator system comprising accumulator 117, cylinder space 110*a*, and piston 118 may be used for augmenting the working pressure. Piston 118 is applied against the top side of ram plate 114 and thus exerts pressure, through movable tool part 115, on workpiece 113.

Figure 4:
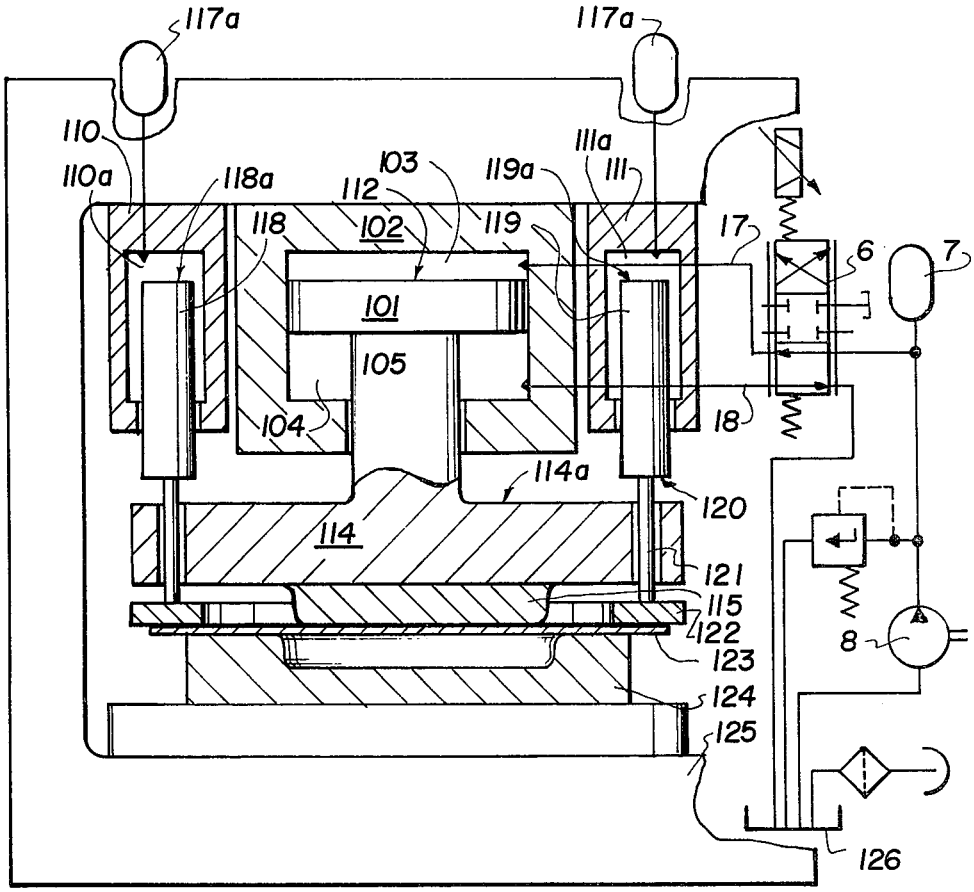
FIG. 4 is a view, similar to FIG. 1 of still another embodiment of the invention.

FIG. 4 shows another embodiment similar to that of FIG. 2, in which the accumulator system, comprising accumulator 117*a*, cylinder space 111*a*, and piston 119. The accumulator system of FIG. 4 is utilized for actuating a blank holder 122. During the return movement of drive piston 101, both holder 122 and ram plate 114 move upwardly. That is, upon covering a certain distance, top side 114*a* of ram plate 114 applies against surface 120 of piston 119, pushes the piston upwardly and thus pressurizes the accumulator system 119, 111*a*, 117*a*. During the working stroke of the press, piston 119 follows the downward movement of ram plate 114 until its motion is stopped through compression rod 121 which is supported by the blank holder 122 and extends through ram plate 114. From this instant, the second pressure accumulator system, comprising accumulator 117*a*, cylinder space 111*a* and piston 119 with piston surface 119*a*, acts through compression rod 121 and holder 122, altogether as a hold-down means for workpiece 123 and presses the workpiece against the fixed lower tool part 124 opposite the upper movable tool part 115. Independently thereof, drive piston 101 moves farther downwardly and causes the deformation of workpiece 123.

The compression rod 121, since it may be selectively removed or inserted, makes it possible to utilize the two lateral, additional cylinder piston systems either for increasing the working pressure or for holding down the workpiece. If more than two of the additional cylinder piston systems of the described kind are provided, they may be used for performing both of those functions, as desired. The pressure accumulators 7, 117 and 117*a* may be designed as separate elements or as a single unit, without affecting their function. The frame of the press is shown at 125.

Figure 3:
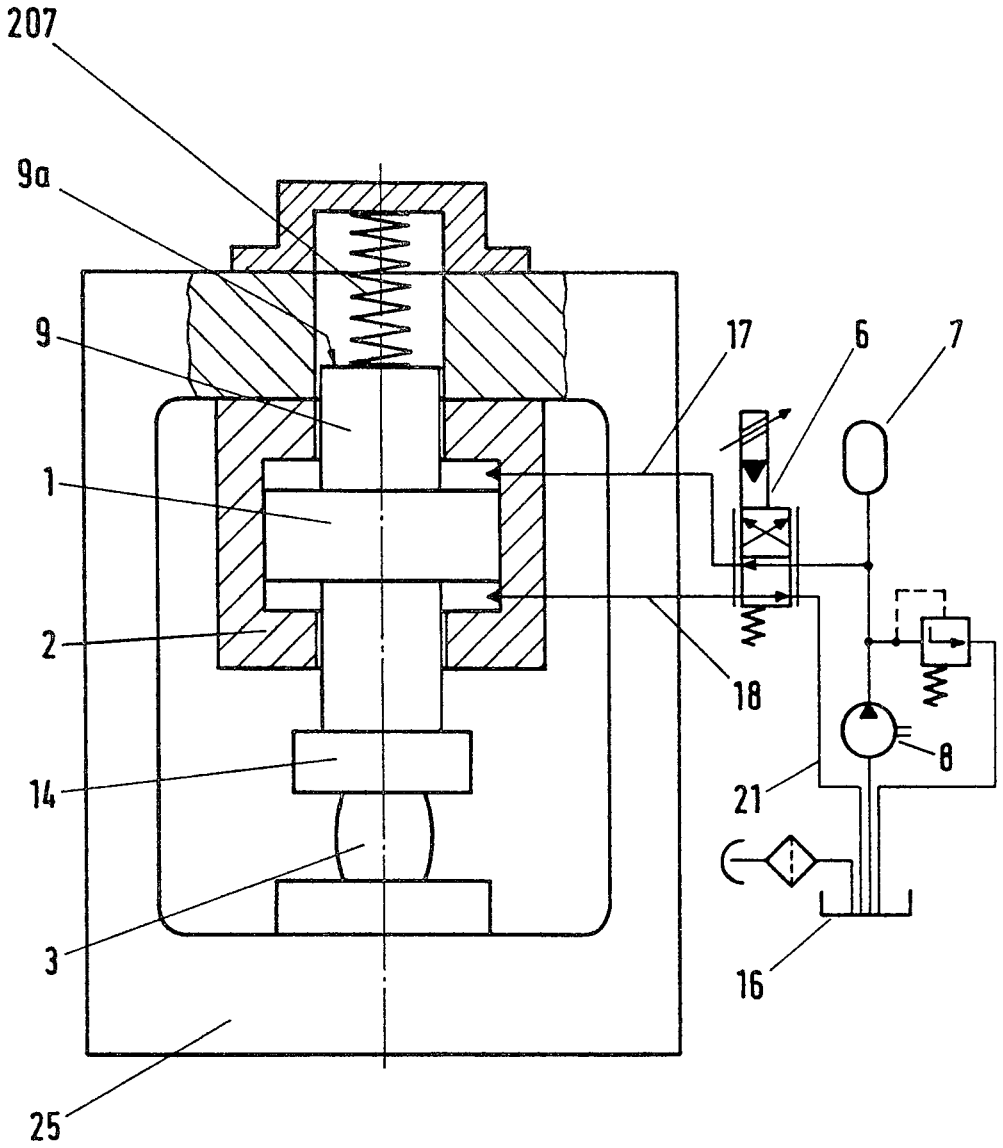
FIG. 3 is a view, similar to FIG. 1, of still another embodiment of the invention.

FIG. 3 shows an embodiment which is substantially identical with that of FIG. 1, as far as the design and drive of piston 1 is concerned. To recover energy and increase the working pressure of drive piston 1, a mechanical spring 207, such as a helical spring or the like, is provided which acts on the upper piston surface 9*a* and is tensioned thereby during the return movement of drive piston 1.

While specific embodiments of the invention have been shown and described in detail to illustrate the application of the principles of the invention, it will be understood that the invention may be embodied otherwise without departing from such principles.

What is claimed is:

1. A servohydraulic press, comprising, a support frame, a workpiece support base in said frame, working cylinder means mounted in said frame over said workpiece support base, a drive piston guided in said working cylinder means for upward and downward movement and having a ram portion extending out of said cylinder means for engagement with a workpiece positioned on said workpiece support base, a cylindrical extension portion defining a central piston operatively connected to said drive piston, said cylinder means having a second cylinder portion into which said central piston projects, said drive piston having a first drive surface exposed to pressure in said cylinder means and a second opposite return surface in said cylinder means, a pressure connection connected to said cylinder means, a servo-valve operatively connected to said pressure connection being operative for selectively pressurizing and releasing the pressure acting on said drive surface or said return surface for alternately moving said drive piston in a working direction toward the workpiece and in an opposite return direction, and an accumulator connected to said servo-valve for selective communication with said cylinder means on respective drive surface and return surface sides of said piston and said second cylinder portion, said accumulator being effective to receive fluid pressure from said second cylinder portion during the return movement in an amount corresponding to the product of the stroke of said central piston times said central piston surface area, said return surface being considerably larger than required for the needed return force, the pressure energy in excess produced during the return direction of movement of said drive piston forcing fluid from said second cylinder portion to said accumlator.

2. A servohydraulic press, as claimed in claim 1, further comprising a fluid line providing a fluid communication between said first drive surface and said second opposite return surface, and a fluid pressure control means for selectively opening and closing said fluid line.

3. A servohydraulic press, as claimed in claim 1, further comprising a check valve and a control valve arranged in parallel in said pressure connection connected to said cylinder.

4. A servohydraulic press, as claimed in claim 3, further comprising a fluid pressure supply tank in fluid communication with said pressure connection, a pump connected to said tank for pumping said fluid to said accumulator and to said servo-valve, an additional connection line connected to said tank and said second cylinder portion, and a check valve disposed in said connection line to prevent back flow to said tank.

5. A servohydraulic press, as claimed in claim 1, wherein said second cylinder portion includes a cylinder space adjacent said central piston surface area, said pressure connection having a first connection from said servo-valve to said cylinder space and a second connection to said cylinder means in the cylinder space adjacent said return side of said drive piston, said central piston surface being movable in said cylinder space, a fluid line connecting said cylinder space and said drive side of said drive piston, and a check valve disposed within said fluid line for preventing flow from said cylinder space to said drive side of said drive piston.

6. A servohydraulic press, as claimed in claim 5, wherein said central piston is connected directly to said drive piston.

7. A servohydraulic press, comprising a support frame, a workpiece support base in said frame, first cylinder means mounted in said frame over said workpiece support base, a drive piston guided in said first cylinder means for upward and downward movement and having a ram portion extending out of said first cylinder means for engagement with a workpiece positioned on said workpiece support base, a second cylinder means mounted in said frame, a piston member operatively connected to said ram being movably received in said second cylinder means and having a surface exposed to pressure in said second cylinder means, said drive piston having a first drive surface exposed to pressure in said first cylinder means and a second opposite return surface in said cylinder means, a pressure connection connected to said first cylinder means, a servo-valve operatively connected to said pressure connection being operative for selectively pressurizing and releasing the pressure acting on said drive surface or said return surface for alternately moving said drive piston in a working direction toward the workpiece and in an opposite return direction, accumulator means connected to said servo-valve for selective communication with said first cylinder means on respective drive surface and return surface sides of said piston and said accumulator means and being effective to receive fluid pressure during the return movement in an amount corresponding to the product of the stroke of said piston times the difference in area between said return surface and the combination of said drive surface and piston member surface.

8. A servohydraulic press, as claimed in claim 7, wherein said accumulator means includes a first accumulator connected to said servo-valve, and a second accumulator connected to said second cylinder means.

9. A servohydraulic press, as claimed in claim 7, wherein said return surface side of said drive piston is larger than that required for the return force, the pressure energy in excess produced during the return direction of movement of said drive piston being directed to said accumulator means.

10. A servohydraulic press, as claimed in claim 7, further comprising a hold-down rod connected to said piston member being engageable with the workpiece for holding it down.

11. A method of operating a fluid pressure operated press having a drive piston movable in a cylinder means with a drive surface side and an opposite return surface side and with a ram connected to the return surface side which is operable on a workpiece, a piston means movable in the cylinder means operatively connected to the ram and having a piston means surface side, and using an accumulator of fluid pressure selectively connectable to the drive and return side, and the piston surface sides comprising, directing the fluid pressure against the drive side to move the drive piston to engage the workpiece, and, in order to return the drive piston, applying a fluid pressure to the return surface side, simultaneously connecting the piston means surface side to the accumulator so as to enable the fluid pressure to be displaced against the accumulator and wherein a part of the force acting on the return side will overcome friction to lift the drive piston from the workpiece and to remove fluid from the accumulator as needed during the return movement in an amount equal to the product of the stroke times the return side area of the drive piston and to deliver fluid to the accumulator in an amount equal to the stroke times the surface area of the piston surface so that the product of fluid spent during the return movement is equal to the stroke times the difference between the areas of the piston means surface side and return surface side.

12. A fluid pressure operated press for forming a workpiece, comprising, a working cylinder, a drive piston movable in said cylinder having a first drive surface side and an opposite second return surface side, said cylinder having a first cylinder space in which said first side is movable and a second cylinder space in which said second side is movable, a ram connected to said drive piston second side and being movable by said drive piston to contact and to form the workpiece, fluid pressure control means connected between said first cylinder space and said second cylinder space to regulate the pressure therebetween, fluid pressure supply means for pressurizing respective first and second sides of said drive piston, a servo-valve having respectively alternately operable connection means to said first and second cylinder spaces and to said fluid pressure supply means for selectively pressurizing said first and second cylinder spaces, a pressure accumulator connected to said servo-valve for selectively communicating said accumulator to respective first and second cylinder spaces, and said return surface side and said drive surface side of said piston having equal areas and that during part of the working stroke of the driving piston, said first and second cylinder spaces are connected to each other through said fluid pressure control means, said servo-valve being effective to shut off the connection to said accumulator.

13. A servohydraulic press, comprising, a support frame, a workpiece support base in said frame, first and second cylinder means mounted in said frame over said workpiece support base, a drive piston guided in said first cylinder means for upward and downward movement and having a ram portion extending out of said cylinder means for engagement with a workpiece positioned on said workpiece support base, piston means movable in said second cylinder means operatively connected to said ram and having a piston means surface side exposed to pressure in said second cylinder means, said drive piston having a first drive surface exposed to pressure in said first cylinder means and a second opposite return surface in said first cylinder means, a pressure connection connected to said first cylinder means, a servovalve operatively connected to said pressure connection being operative for selectively pressurizing and releasing the pressure acting on said drive surface, said piston means surface or said return surface, for alternately moving said drive piston in a working direction toward the workpiece and in an opposite return direction, and accumulator means connected to said servo-valve for selective communication with said first cylinder means and connected directly to said second cylinder means, said accumulator means being effective to receive fluid pressure during the return movement in an amount corresponding to sum of the product of the stroke and said drive piston times said piston surface area on the drive side and the product of the stroke of said piston means times said piston means surface, said return surface being considerably larger than required for the needed force, the pressure energy in excess produced during the return direction of movement of said drive piston forcing fluid from said second cylinder portion to said accumulator.

* * * * *